US010619283B2

(12) United States Patent
Bringewatt et al.

(10) Patent No.: US 10,619,283 B2
(45) Date of Patent: Apr. 14, 2020

(54) METHOD FOR THE WET-TREATMENT, PREFERABLY THE WASHING, OF LAUNDRY

(71) Applicant: Herbert Kannegiesser GmbH, Vlotho (DE)

(72) Inventors: Wilhelm Bringewatt, Porta Wetfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 356 days.

(21) Appl. No.: 14/243,974

(22) Filed: Apr. 3, 2014

(65) Prior Publication Data

US 2014/0304925 A1 Oct. 16, 2014

(30) Foreign Application Priority Data

Apr. 11, 2013 (DE) ..... 10 2013 006 200

(51) Int. Cl.
*D06F 39/00* (2020.01)
*D06F 31/00* (2006.01)
*D06F 34/22* (2020.01)

(52) U.S. Cl.
CPC ..... *D06F 34/22* (2020.02); *D06F 31/005* (2013.01)

(58) Field of Classification Search
CPC ..... D06F 39/00; C11D 11/00
USPC ..... 8/115.51, 142, 159
See application file for complete search history.

(56) References Cited

U.S. PATENT DOCUMENTS 4,434,196 A * 2/1984 Robinson ..... C11D 3/18 427/389
4,546,511 A * 10/1985 Kaufmann ..... D06F 31/005 134/107
6,681,429 B2 * 1/2004 Mehrmann ..... D06F 31/005 68/145
2002/0116770 A1 * 8/2002 Mehrmann ..... D06F 31/005 8/158
2005/0183208 A1 * 8/2005 Scheper et al. ..... 8/142
(Continued)

FOREIGN PATENT DOCUMENTS

DE 102011015188 A1 9/2011
EP 0287761 A2 10/1988
(Continued)

OTHER PUBLICATIONS

DE10031040A1 translation, pp. 1-11. Feb. 15, 2001.*
(Continued)

*Primary Examiner* — Gregory R Delcotto
*Assistant Examiner* — Preeti Kumar
(74) *Attorney, Agent, or Firm* — Laurence P. Colton; Smith Tempel Blaha LLC

(57) ABSTRACT

Washed laundry that has been rinsed still contains bound acidic or basic rinsing liquid. In many cases this must be neutralized. This used to be conducted on the basis of values gained from experience, which generally resulted in only partial neutralization. Herein, sample liquid is taken continuously from the neutralization chamber (18) and, after the fine filtration of same, the pH value of the sample liquid is continuously measured by a pH value measurement device (31). In this manner a pH value control system is possible which ensures an automatic and complete neutralization of the rinse liquid still bound in the laundry after rinsing.

15 Claims, 2 Drawing Sheets

(56) References Cited

U.S. PATENT DOCUMENTS

| | | | | |
|---|---|---|---|---|
| 2008/0017568 | A1* | 1/2008 | Robert | B04C 5/13 210/413 |
| 2012/0172439 | A1* | 7/2012 | Fast | C07C 407/00 514/558 |
| 2014/0304925 | A1* | 10/2014 | Bringewatt | D06F 39/004 8/137 |

FOREIGN PATENT DOCUMENTS

| | | | | |
|---|---|---|---|---|
| EP | 1705156 | A1 * | 9/2006 | C02F 1/5236 |
| WO | 95/04128 | A1 | 2/1995 | |
| WO | WO 2010144744 | A2 * | 12/2010 | D06F 31/005 |

OTHER PUBLICATIONS

Filtration—Wikipedia pp. 1-5, 2018.*
Milnor CBW model tunnel washer handbook, 106 pages, 2017.*
European Patent Office, Recherchenbericht (Search) on parent patent application, May 20, 2014.

* cited by examiner

METHOD FOR THE WET-TREATMENT, PREFERABLY THE WASHING, OF LAUNDRY

STATEMENT OF RELATED APPLICATIONS

This patent application claims the benefit of German Patent Application No. 10 2013 006 200.4 having a filing date of 11 Apr. 2013.

BACKGROUND OF THE INVENTION

Technical Field

The invention relates to a method for the wet-treatment, preferably the washing, of laundry, wherein the laundry is first washed and rinsed and, after rinsing, a neutralization of the laundry is carried out in that neutralizing agent is added as necessary to the liquid in which the laundry is located and/or which is bound in the laundry.

Prior Art

The wet-treatment of laundry is usually carried out by means of washing, rinsing and, if appropriate, at least one aftertreatment. One such type of aftertreatment can involve neutralization.

The neutralization of the washed laundry items is necessary if, for example, the wash liquid takes on an acidic or alkaline pH value resulting from treatment additives, for example detergents, employed during washing. The acidic or alkaline treatment fluid cannot be completely removed during the rinsing operation which follows the washing process. This applies in particular to the treatment liquid bound in the laundry items, that is to say, the bound liquor. Prior to the invention, the method employed to neutralize the bound treatment liquid after rinsing was to employ a neutralizing agent in an estimated quantity or based on values gained from practical experience. In general this results in an overdose of the neutralizing agent. This causes the pH value to shift from an acidic range to an alkaline one, or vice versa, so that a sufficient neutralization is no longer possible. Furthermore, an overdosage of the neutralizing agent adds to environmental pollution and results in unnecessary high costs.

BRIEF SUMMARY OF THE INVENTION

The object of the invention is to provide a method for the wet-treatment of laundry items which results in a complete, or at least virtually complete, neutralization using the smallest possible quantity of neutralizing agents.

A method for achieving this object is a method for the wet-treatment, preferably the washing, of laundry, wherein the laundry is first washed and rinsed and, after rinsing, a neutralization of the laundry is carried out in that neutralizing agent is added as necessary to the liquid in which the laundry is located and/or which is bound in the laundry, characterized in that at least one sample is taken from the liquid, the sample is filtered and at least one pH value of the filtered sample is measured, with neutralizing agent being added as necessary to the liquid in a targeted manner based on the pH value of the liquid obtained from the measurement. Accordingly, it is provided that at least one sample is to be taken of the liquid added to the laundry after the rinsing cycle. The sample is filtered, with the pH value of the filtered sample then being measured. If the measurement indicates an acidic or alkaline pH value, neutralization agent is added to the liquid in a targeted manner. The pH value of the laundry liquid after rinsing can thus be specifically set to a neutral pH value. The method according to the invention can preferably be employed to regulate the pH value of the liquid in order to achieve a pH-neutral or an essentially pH neutral liquid.

The method preferably provides that samples are repeatedly taken from the liquid that is supplied to the laundry items after rinsing. Here, too, every sample is first filtered, with the pH value of each sample then being determined from the filtered sample. By comparing a plurality of samples, it is possible to determine the change in the pH value. In particular, it can thus be established how the pH value changes as a result of the added neutralization agent. The setting of the pH value or the neutralization of the liquid added to the laundry after rinsing can thus be changed or adjusted little by little, preferably iteratively. Preferably only small quantities of neutralization agent are ever added to the liquid, specifically until the subsequently measured samples reach a neutral pH value indicating complete or virtually complete neutralization. This effectively prevents an overdosage of the neutralization agent or even a shift in the pH value from an acidic pH value to an alkaline pH value, or vice versa.

An advantageous further development of the method provides that the targeted addition of at least one neutralization agent does not commence until there is no change or no significant change in the pH value of two successive samples. This ensures that neutralization does not begin until the rinse liquid carried over from the rinsing operation and still bound in the laundry has sufficiently mixed with the liquid added to the laundry after rinsing in order that the sample taken from the liquid corresponds to the actual pH value of the liquid containing the rinsing liquid still bound in the items of laundry. The measured pH value of the liquid containing the bound rinsing liquid from the laundry then provides a reliable value for the subsequent start of the neutralization procedure. While neutralization is taking place, the progress of neutralization is determined by taking further samples on a continuous basis and then ending any further addition of neutralization agent when a neutral pH value has been measured.

In the case of the advantageous method, a filtration of the samples is carried out, preferably of all samples of the liquid, prior to the measurements of the pH value. The filtration method is preferably fine filtration or even microfiltration. If necessary, even finest filtration can be performed. The fine or finest filtration of at least the samples removes from the sample any components which might influence the measurement of the pH value. The filtered sample thus allows for an exact pH value measurement. Above all, this prevents accompanying substances in the samples from negatively affecting the measuring technique or measuring sensors and thus any possible distortion of the measurement results.

According to a preferred design of the method, samples of the liquid added after the rinsing of the laundry are taken via a bypass. A small quantity of sample liquid, in particular a small measuring volume flow, is taken through the bypass, preferably continuously. The bypass allows for continuous sampling.

It is preferably provided that, after the metered addition of preferably small quantities of at least one neutralizing agent to the liquid added to the water after rinsing, samples of the liquid are repeatedly taken along with the neutralizing agent already added to it. These samples are also filtered, in particular fine filtered, before their pH value is measured. If the pH value measurement of the sample most recently taken still indicates an acidic or alkaline pH value, in other words that complete neutralization has not yet been reached, small quantities of neutralizing agent continue to be added to the liquid, with at least one further pH value measurement being taken afterwards. Only when the pH value measurement of the last sample indicates that neutralization has been achieved or that the liquid has been substantially set to a neutral pH value, is the neutralization process concluded and no further samples are taken. The neutralization process is thus incremental and controllable, preferably controlled automatically.

According to the method it is preferably provided that fresh water and/or recycled water is used as the liquid added after the rinsing of the laundry. In the case of recycled water, this for example is water that accumulates during the removal of water from the laundry after the neutralization process has been carried out, that is to say so-called press water or also dewatering fluid. This liquid already contains neutralized water or neutralized liquid that can also be used after the rinsing of the laundry to dilute any acidic or alkaline rinsing liquid remaining in the laundry and subsequently to neutralize it. It also conceivable that, following the rinsing step and prior to the start of the neutralization process, fresh water as well as recycled water or recirculated liquid is added. The amount of fresh water required for neutralization can hereby be at least reduced.

Another preferred development of the method provides for the taking of samples and/or the metered addition of at least one neutralization agent while the laundry is being agitated in the liquid. The rinse liquid bound in the laundry is thereby flushed out of the laundry by the liquid added after rinsing, in particular pH neutral liquid, and mixed with the liquid added after rinsing. Here the bound rinse liquid is diluted with the added pH neutral liquid that is present in a much greater volume. The pH neutral liquid added to and mixed with the still acidic or alkaline bound rinse liquid can then be effectively neutralized.

Furthermore, provision is preferably made for the laundry to be washed, rinsed and neutralized in a tunnel-type washing machine having a rotary driven drum with successive chambers. In the drum, which is also driven in rotation during neutralization, the pH neutral liquid is moved or mixed with the laundry and the bound rinse liquid contained therein.

According to a further advantageous design of the method, provision is made for taking the samples from the chamber of the tunnel-type washing machine in which the neutralization of the laundry is carried out, preferably from a stationary outer drum assigned to this chamber. This is preferably done by means of a bypass line. The bypass line allows for a continuous withdrawal of a measuring volume flow, namely a relatively small quantity of sample liquid. By having neutralization take place in at least one of the tunnel-type washing machine's own chambers, with the drum being driven in the same manner of rotation as during the washing and rinsing of the items of laundry, the laundry is agitated during neutralization and mixed in the liquid to be neutralized. Also preferred is neutralization of the laundry in the liquid when the drum of the tunnel-type washing machine is driven in rotation. In this case the at least one chamber used for carrying out the neutralization of the laundry rotates exactly as the other chambers for washing and rinsing the laundry. This also promotes effective neutralization, with the collected samples exhibiting a representative pH value as a result of the intensive mixing of the neutral pH liquid added after the rinsing of the laundry with the bound rinsing liquid remaining in the laundry from the rinsing process.

BRIEF DESCRIPTION OF THE DRAWINGS

A preferred exemplary embodiment of the invention is described in more detail below on the basis of the drawings, which show.

DETAILED DESCRIPTION OF PREFERRED EMBODIMENTS

In the following, the invention will be described in conjunction with the wet treatment of laundry in commercial laundries by means of a tunnel-type washing machine 10. It is in the tunnel-type washing machine 10 where washing, rinsing and aftertreatment, in particular neutralization, of the laundry is carried out. The laundry can involve any kind of laundry item, specifically flat textiles, clothing, in particular working clothes, but also dirt mats and the like.

Figure 1:
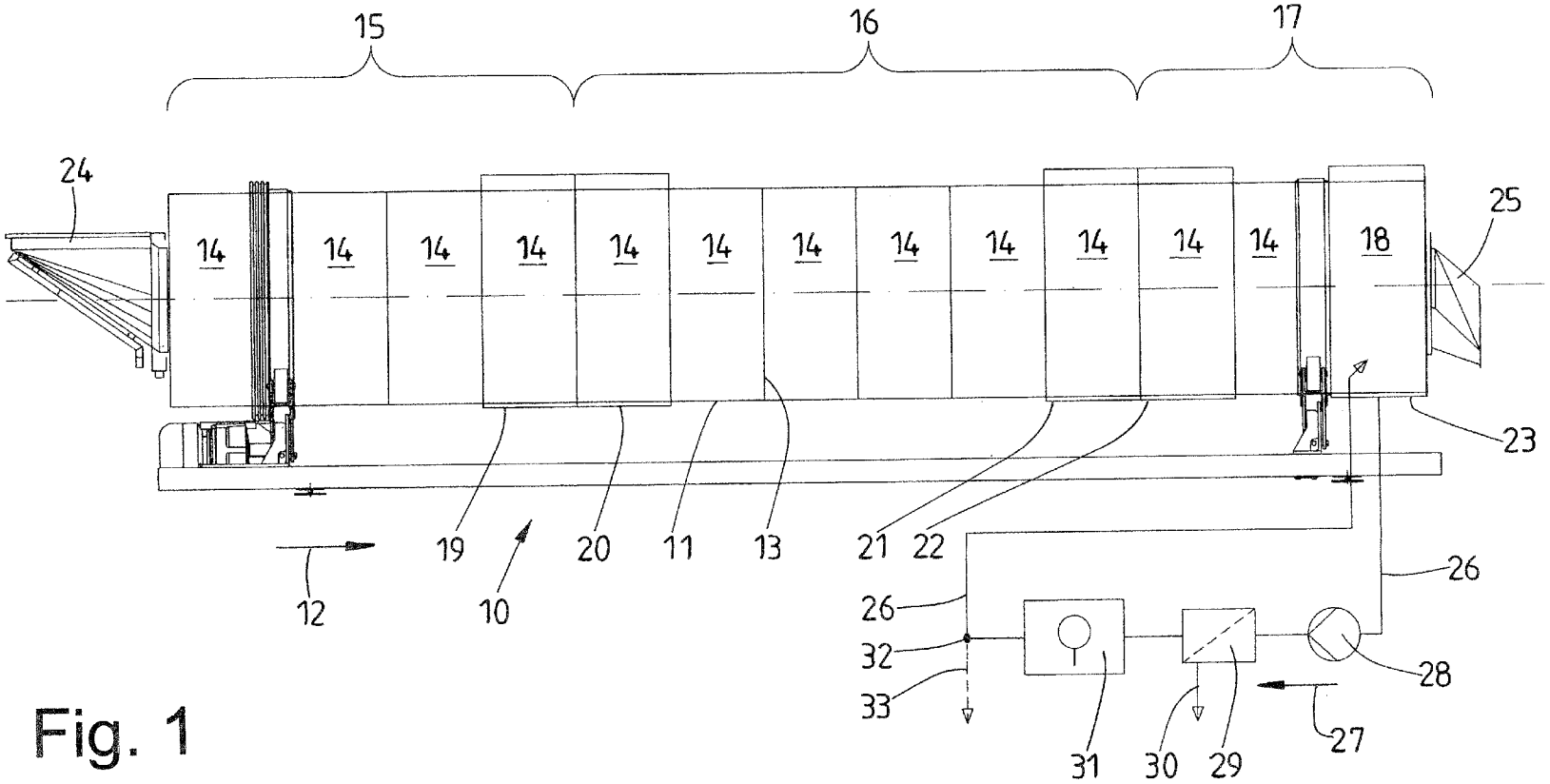
FIG. 1 is a schematic side view of a tunnel-type washing machine with a sample collecting and pH value measuring device.

The tunnel-type washing machine schematically illustrated in FIG. 1 is equipped with a drum 11 which can be driven to rotate or swivel (in a reciprocating movement) about a preferably horizontal axis of rotation. The laundry to be washed is transported in batches in the passage direction 12 through the rotating or swiveling cylindrical drum 11, specifically, in reference to the illustration in FIG. 1, from left to right. A plurality of chambers 14 which follow one another in the passage direction 12 are formed in the drum 11 by transversely directed partition walls 13. The chambers 14 can have the same size or vary in size. The tunnel-type washing machine 10 shown in FIG. 1 has thirteen successive chambers 14. However, the invention is not limited to this number of chambers. The invention is also suited for tunnel-type washing machines 10 having a greater or lesser number of successive chambers 14.

The shown tunnel-type washing machine 10 has three successive treatment ones which follow each other in the passage direction 12, specifically a prewash zone 15, a main-wash zone 16 and a rinse zone 17. A neutralization zone is integrated into the rinse zone 17. In the case of the tunnel-type washing machine 10 shown here, the neutralization zone is formed by a single chamber 14 of the tunnel-type washing machine 10, namely by a neutralization chamber 18. The neutralization chamber 18 is the last chamber 14 of the rinse zone 17, as seen in the passage direction 12, and is at the same time also the last chamber 14 of the tunnel-type washing machine 10.

The rotary driven drum 11 of the tunnel-type washing machine 10 is assigned a plurality of stationary and liquid-tight outer drums 19 to 23. A first outer drum 19, as seen in the passage direction 12, is situated at the end of the prewash zone 15. A second outer drum 20 is arranged at the start of the main-wash zone 16. In addition, there is a third outer drum 21 at the end of the main-wash zone 16. A fourth outer drum 22 is arranged at the start of the rinse zone 17 and a fifth (and final) outer drum 23 is located at the end of the rinse zone 17. This outer drum 23 is assigned to the neutralization chamber 18 at the end of the tunnel-type washing machine 10.

Located in front of the drum 11 is a loading chute 24 by means of which the tunnel-type washing machine 10 is loaded with dirty laundry that is sent through the loading chute 24 into the first chamber 14 of the prewash zone 15. Situated at the end of the tunnel-type washing machine 10 is a discharge chute 25. The washed, rinsed and neutralized laundry exits the neutralization chamber 18 of the tunnel-type washing machine 10 via the discharge chute 25. From the discharge chute 25 the washed, rinsed and neutralized items of laundry still containing the bound neutralized liquid, the bound liquor, can be fed to a dewatering device, such as a water-removal press or a centrifuge.

A bypass line 26 runs from the lowest point of the outer drum 23 assigned to the neutralization chamber 18. This line is used to collect samples, it preferably being possible to take a small quantity or a small volume flow of liquid (sample liquid) from the neutralization chamber 18. A pump 28 is situated in the bypass line 26. As seen in the direction of flow 27 of the sample liquid pumped by the pump 28 through the bypass line 26, the pump 28 is followed by a filter 29. The filter 29 is preferably a fine filter for the fine filtration, or a micro filter for the micro filtration, of the sample liquid. But it can also be a finest filter. The filter 29 is assigned a discharge line 30 for substances or particles filtered out of the sample liquid. As seen in the flow direction 27 of the sample fluid, the filter 29 is followed by a pH-value measuring device 31. The pH value measuring device 31 employed is one which determines the pH value in the filtered sample liquid as the latter passes through the pH value measuring device 31. The bypass line 26 is led back from the pH value measuring device 31 to the outer drum 23 of the neutralization chamber 18. Provided in the section of the bypass line 26 which follows the pH value measuring device 21, as seen in the flow direction 27 of the sample liquid, is a junction 32 leading to a drain pipe 33. The drain pipe 33 can lead to a drain, for example. By virtue of a valve assigned to the junction 32, the sample liquid that has already passed the pH value measurement device 31 can be alternatively returned to the neutralization chamber 18 or directed into the drain pipe 33.

The neutralization chamber 18 is assigned a feed line for at least one neutralization agent. In addition, a metering device (not shown) is provided for the at least one neutralizing agent. The metering device can be integrated into the pH value measuring device 31 and likewise a control system for metering the quantity of the neutralizing agent to be added. Preferred for such use is a liquid neutralizing agent or a neutralizing agent dissolved in a liquid. This can be fed through the bypass line 26 along with the at least one neutralizing agent and the measured sample liquid to the neutralization chamber 18 of the tunnel type-washing machine 10. But it is also conceivable to supply a neutralizing agent at a different location (not shown) of the neutralization chamber 18. For example, this can be the case if a solid neutralizing agent is employed. The metering device is then also positioned at the location where the neutralizing agent is fed to the neutralization chamber 18. The control system can then be assigned to the metering device or integrated therein. However, the control system for the quantity of neutralizing agent to be added can also be located elsewhere, such as being assigned to the pH value measurement device 31 or integrated therein.

Figure 2:
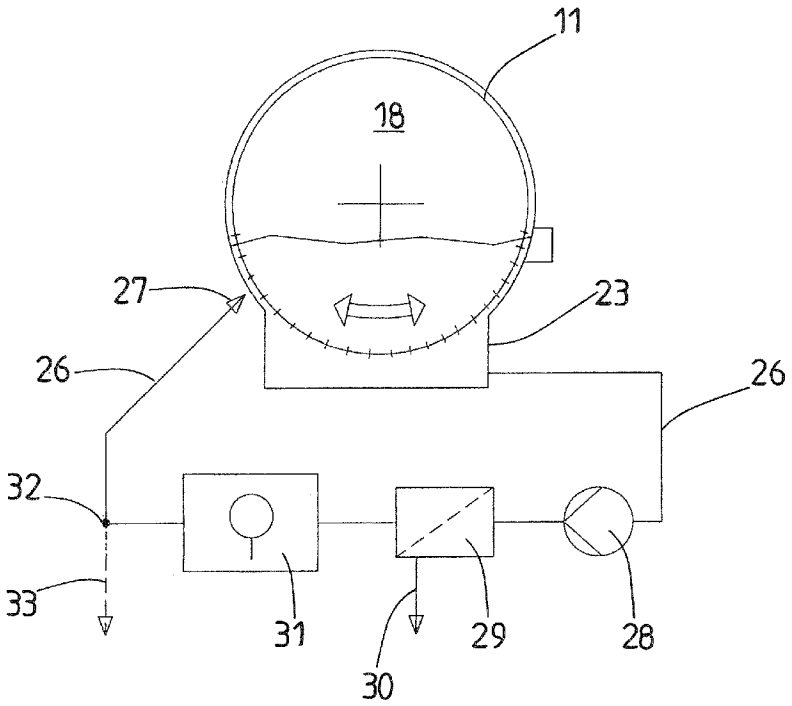
FIG. 2 is a cross-sectional view through the chamber of the tunnel-type washing machine in which a neutralization process is conducted with the device for collecting samples, filtration and measuring the pH value of the sample.

In the following, the method according to the invention will be described in more detail with reference to FIGS. 1 and 2 of the drawings:

A plurality of laundry batches are concurrently prewashed, washed and rinsed in the rotary-driven or swivel-driven drum 11 of the tunnel-type washing machine 10 and neutralized in the neutralization chamber 18.

The respective batch of laundry, along with the free rinse liquid and rinse liquid bound in the laundry, is transferred from the second (middle) chamber 14 of the rinse zone 17 to the neutralization chamber 18. The free rinse liquid is then discharged from the outer drum 23 of the neutralization chamber 18, so that only the rinse liquid bound in the laundry (bound liquor) remains in the batch of laundry. The neutralization chamber 18 is then filled with preferably pH neutral liquid. This can be either fresh water or even recycled water or some other recycled pH neutral liquid, for example liquid from the water-removal process that has been separated from the laundry in the water-removal step which follows the neutralization process and stored temporarily in a reservoir (not shown).

While other batches of laundry are being prewashed, washed and rinsed in the other chambers 14, the laundry in the neutralization chamber 18 is flushed by the pH neutral liquid as the drum 11 is driven in a rotary or swiveling movement, with the rinse liquid bound in the laundry mixing with the added pH neutral liquid, i.e. the neutralization liquid, as a result of the laundry being agitated in the latter.

Immediately after the liquid is fed to the neutralization chamber 18, there commences the removal from the neutralization chamber 18 of a small partial flow of the liquid as a sample liquid via the bypass line 26 in the flow direction 27. This is preferably conducted in a continuous manner, thus allowing for a constant removal of sample liquid from the neutralization chamber 18 through the bypass line 26 during the agitation of the laundry in the neutralization chamber 18.

During the initial mixing of the bound rinse liquid in the laundry with the added pH neutral liquid, no neutralization is yet carried out by the addition of a neutralizing agent. However, the current pH value is measured, preferably at regular intervals, during the mixing of the added pH neutral liquid with the bound rinse liquid without the addition of a neutralizing agent. As the added and originally pH neutral liquid increasingly mixes with the rinse liquid bound in the laundry and the laundry continues to be agitated in the added liquid over a period of time, a constant pH value is reached in the samples taken from the sample liquid. As soon as this is the case, in other words, as soon as the ongoing measured pH value of the sample liquid no longer changes, or does not change significantly, the neutralization process commences.

Depending on the measured pH value of the bound rinse liquid mixed together with the added liquid, namely the sample liquid, an appropriate neutralizing agent is added successively, preferably in small quantities, to the liquid mixed with the bound rinse liquid in the neutralization chamber 18. In the process, an ongoing measurement is made of the pH value in the sample liquid, which changes as small quantities of the neutralizing agent are added. The addition of small quantities of neutralizing agent continues until the measurements indicate that the sample fluid has reached a neutral or virtually neutral pH value, in other words, when the neutralization of the liquid in the neutralization chamber 18 is complete.

It is conceivable that, shortly before the end of the neutralization process, the intervals between the addition of the neutralizing agent are altered, preferably lengthened, and/or the quantity of the at least one added neutralizing agent is reduced. This allows a reliable determination to be made during the final phase of the neutralization process as to whether a neutral pH value has been established during the mixing of the laundry with the liquid and the added neutralization agent and whether the neutralization process is being precisely controlled or regulated.

The sample liquid is continuously pumped by the pump 28 through the bypass line 26 in the flow direction 27. Downstream of the pump 28, as seen in the flow direction 27, the sample fluid flows through the filter 29, preferably the fine or finest filter. The sample fluid is filtered in said filter. This preferably involves fine filtration, finest filtration or micro-filtration. Once filtered by the filter 29, the sample fluid then flows in the flow direction 27 through the pH value measurement device 31. In the latter, successive samples of the sample liquid are measured with respect to their pH value. This measurement is conducted at successive intervals, preferably brief successive intervals. The intervals between measurement can be equal in length but can also become longer as the neutralization process progresses. Taking measurements of the pH value of the samples at successive intervals results in a virtually continuous pH value measurement.

Upon leaving the pH value measurement device 31 in the flow direction 27, the sample fluid can be optionally diverted to a drain via the drain pipe 33 or can also be fed back into the neutralization chamber 18 via the bypass line 26.

The metered addition of at least one liquid or liquefied neutralizing agent can be conducted in the region of the pH value measurement device 31. However, it is also conceivable to add at least one neutralizing agent directly to the neutralization chamber 18 at some other appropriate location.

The addition of at least one neutralizing agent to the sample liquid that has been fed back into the neutralization chamber 18 or the direct addition of at least one neutralizing agent to the liquid in the neutralization chamber 18 is performed by a metering device (not shown). The metering device is controlled or regulated by a corresponding actuating means, specifically as a function of the pH value that has been determined by the pH value measurement device 31. To this end, the metering device, or also the pH value measurement device 31, is assigned a control or regulation means, in particular in the form of a computer.

The method according to the invention can be utilized not only in conjunction with the tunnel-type washing machine 10 shown in the figures, but also with any tunnel-type washing machine of any design, in particular with an arbitrary number of chamber 14. The method according to the invention can also be utilized with other washing machines used in commercial laundries, such as wash centrifuge machines.

LIST OF DESIGNATIONS

10 tunnel-type washing machine
11 drum
12 passage direction
13 partition wall
14 chamber
15 prewash zone
16 main-wash zone
17 rinse zone
18 neutralization chamber
19 outer drum
20 outer drum
21 outer drum
22 outer drum
23 outer drum
24 loading chute
25 discharge chute
26 bypass line
27 flow direction
28 pump
29 filter
30 discharge line
31 pH value measurement device
32 junction
33 drain pipe

What is claimed is:

1. A method for the wet-treatment of laundry, wherein the laundry is first washed and rinsed and, after rinsing, a neutralization of the laundry is carried out in that neutralizing agent is added as necessary to liquid in which the laundry is located and/or which is bound in the laundry, comprising the steps of:

a) washing and rinsing the laundry in a tunnel-type washing machine having a drum with successive chambers, wherein the neutralization of the laundry is carried out in one of the successive chambers; then b) after the rinsing of the laundry, repeatedly taking a sample from the liquid from the chamber of the tunnel-type washing machine in which the neutralization of the laundry is carried out; then c) filtering the sample resulting in a filtered sample, wherein the filtering is a filtration method selected from the group consisting of fine filtration, micro-filtration, and finest filtration; then d) measuring the pH value of the filtered sample; then e) repeating steps b) through d) if necessary until there is no change in the pH value of at least two successive samples of the filtered sample; then f) adding the neutralizing agent as necessary to the liquid in a targeted manner based on the pH value of the at least two successive samples in which there is no change in the pH value; then g) measuring the pH value of the liquid to which the neutralizing agent has been added; and then h) if the pH value of the liquid to which the neutralizing agent has been added is not neutral or essentially neutral, repeating steps f) through g) until the pH value of the liquid is neutral or essentially neutral, so as to prevent an overdosage of the neutralizing agent from an acidic pH to an alkaline pH or vice versa.

2. The method according to claim 1, further comprising removing the at least one sample through a bypass line prior to step b).

3. The method according to claim 1, wherein, following the rinsing of the laundry, adding pH neutral liquid to the liquid.

4. The method according to claim 1, wherein the taking of the at least one sample and/or the addition of the neutralizing agent is carried out as the laundry is being agitated in the liquid.

5. The method according to claim 4, wherein the laundry is agitated in the liquid by a rotating drive of the drum of the tunnel-type washing machine that contains the successive chambers.

6. The method according to claim 2, wherein the at least one sample is removed continuously from the liquid.

7. The method according to claim 6, wherein the at least one sample is removed from the liquid together with the added neutralizing agent.

8. The method according to claim 1, further comprising, prior to step b), continuously removing the at least one sample through a bypass line after the addition of the neutralizing agent to the liquid in which the laundry is located, wherein the at least one sample is removed from the liquid together with the added neutralizing agent.

9. The method according to claim 3, wherein the pH neutral liquid is selected from the group consisting of fresh water and recycled water.

10. The method according to claim 9, wherein the recycled water is dewatering liquid accumulated during the water-removal process which follows neutralization.

11. The method according to claim 1, wherein the one of the successive chambers in which the neutralization is carried out is configured as a neutralization chamber and is a last chamber of a rinsing zone of tunnel-type washing machine.

12. The method according to claim 11, wherein the at least one sample is taken through a bypass line from the chamber of the tunnel-type washing machine in which the neutralization of the laundry is carried out.

13. The method according to claim 12, wherein the at least one sample is taken through a bypass line from a stationary outer drum of the neutralization chamber.

14. A method for the wet-treatment of laundry, wherein the laundry is first washed and rinsed and, after rinsing, a neutralization of the laundry is carried out in that neutralizing agent is added as necessary to liquid in which the laundry is located and/or which is bound in the laundry, comprising the steps of:

a) washing and rinsing the laundry in a tunnel-type washing machine having a drum with successive chambers, wherein the neutralization of the laundry is carried out in one of the successive chambers that is configured as a neutralization chamber; then b) after the rinsing of the laundry, and while the laundry is being agitated, continuously taking a plurality of samples from the liquid from a bypass line leading from the chamber of the tunnel-type washing machine in which the neutralization of the laundry is carried out; then c) filtering the plurality of samples resulting in a plurality of filtered samples, wherein the filtering is a filtration method selected from the group consisting of fine filtration, micro-filtration, and finest filtration; then d) measuring the pH value of each of the plurality of filtered samples; then e) repeating steps b) through d) if necessary until there is no change in the pH value of at least two successive samples of the plurality of filtered samples; then f) adding the neutralizing agent as necessary to the liquid in a targeted manner based on a pH value of the at least two successive samples in which there is no change in the pH value; then g) measuring the pH value of the liquid to which the neutralizing agent has been added; and then h) if the pH value of the liquid to which the neutralizing agent has been added is not neutral or essentially neutral, repeating steps f) through q) until the pH value of the liquid is neutral or essentially neutral, so as to prevent an overdosage of the neutralizing agent from an acidic pH to an alkaline pH or vice versa.

15. The method according to claim 14, further comprising adding fresh or recycled water to the liquid after rinsing the laundry, wherein the samples are removed from the liquid together with the added water.

* * * * *